US008079107B2

(12) United States Patent
Katenhusen et al.

(10) Patent No.: US 8,079,107 B2
(45) Date of Patent: Dec. 20, 2011

(54) OVERHEAD THROWING SWEEPING MACHINE

(75) Inventors: Heinrich Katenhusen, Bad Oldesloe (DE); Frank Thormahlen, Bad Oldesloe (DE); Joachim Hartlein, Bad Oldesloe (DE)

(73) Assignee: Hako-Werke GmbH, Bad Oldesloe (DE)

( * ) Notice: Subject to any disclaimer, the term of this patent is extended or adjusted under 35 U.S.C. 154(b) by 982 days.

(21) Appl. No.: 12/029,697

(22) Filed: Feb. 12, 2008

(65) Prior Publication Data

US 2008/0201878 A1 Aug. 28, 2008

(30) Foreign Application Priority Data

Feb. 28, 2007 (EP) ..... 07004157

(51) Int. Cl.
*A47L 11/24* (2006.01)

(52) U.S. Cl. ..... 15/50.3; 15/52.1; 15/49.1; 15/82

(58) Field of Classification Search ..... 15/52.1, 15/49.1, 50.3, 78, 82, 83
See application file for complete search history.

(56) References Cited

U.S. PATENT DOCUMENTS

2006/0230556 A1* 10/2006 Hansen ..... 15/52.1

FOREIGN PATENT DOCUMENTS

| | | | |
|---|---|---|---|
| DE | 19715435 | A1 * | 10/1998 |
| EP | 0957207 | A2 | 11/1999 |
| FR | 2784127 | A1 | 4/2000 |
| GB | 440117 | A | 12/1935 |

* cited by examiner

*Primary Examiner* — Monica Carter
*Assistant Examiner* — Stephanie Newton
(74) *Attorney, Agent, or Firm* — Edwards Wildman Palmer LLP

(57) ABSTRACT

In an overhead throwing sweeping machine, the cylindrical sweeping roller (4) which is rotatable about its longitudinal axis is retained on jointly adjustable pivoted arms, and the dirt container (6) arranged behind the sweeping roller (4) has a receiving opening, the bottom edge (15) of which lies adjacent to the sweeping roller (4). In order to reset the sweeping area of the sweeping roller (4) after wear of the bristles, a cable control (20) is provided which runs over a bearing surface (11) which, at a pivoted arm designed as a double-armed lever and intended for the sweeping roller (4), is formed on that arm (7) of said double-armed lever which is remote from the longitudinal axis (4') of the sweeping roller (4). One end of the cable control (20) is held in place when the sweeping roller (4) is lowered into the sweeping position, whereas the other end is connected to an adjusting mechanism, such that the cable control (20) holds the pivoted arms in the position for the sweeping position of the sweeping roller (4) by engagement with the bearing surface (11). At least one supporting element (36) for the support of the dirt container (6) is coupled to the adjusting mechanism, such that the adjustment of the latter both changes the effective length of the cable control (20) and correspondingly displaces the at least one supporting element (36).

10 Claims, 8 Drawing Sheets

OVERHEAD THROWING SWEEPING MACHINE

The invention relates to an overhead throwing sweeping machine according to the preamble of Claim 1.

In a known sweeping machine of this type (DE 197 15 435 C2), by means of a single actuating operation, the pivoted arms retaining the sweeping roller can be lowered for compensating for the wear of the bristles of the sweeping roller, in order to set the sweeping area and at the same time produce the optimum distance between sweeping roller and wall of the brush tunnel, and the distance of the bottom edge of the inlet opening of the dirt container from the sweeping roller can also be adapted by the dirt container or part of the dirt container being displaced in the direction of the sweeping roller. To this end, the pivoted arms of the sweeping roller are supported on holding elements which are retained in the frame of the machine in a displaceable manner and which have a sloping holding surface and can be displaced in the axial direction of the sweeping machine by means of an actuating mechanism containing Bowden controls. Supporting rods are provided between the holding elements and the retainer for the dirt container, such that the distance between rear ends of the holding elements and the retainer for the dirt container is kept constant, while a spring force acts on the front ends of the holding elements against the direction of the supporting rods.

The holding elements are held in a defined position by Bowden controls of the actuating device, such that, when the sweeping roller is not worn, the pivoted arms of the sweeping roller are supported on the front and thus high end of the holding surfaces of the holding elements. In this rear position of the holding elements with respect to the frame of the sweeping machine, the retainer of the dirt container is located in its position furthest to the rear brought about by the supporting rods.

If the bristles of the sweeping roller are worn beyond a certain degree, it becomes necessary to reset the position of the pivoted arms of the sweeping roller. To this end, the cable of the associated Bowden control, which holds the holding element in its position against the force of the spring, is relaxed, such that the holding element is displaced forwards. As a result, the supports of the pivoted arms pass into a lower region of the holding surfaces of the holding elements, and the pivoted arms are lowered. By the displacement of the holding elements forwards, the supporting rods are also displaced forwards, such that the holding arrangement of the dirt container passes into a position located further forwards and as a result the bottom edge of the inlet opening of the dirt container is positioned again at an optimum distance from the sweeping roller.

The setting device in this previously known overhead throwing sweeping machine performs the task of resetting the longitudinal axis of the sweeping roller and the bottom edge of the inlet opening of the dirt container completely satisfactorily during operation when the bristles are shorted. However, it is composed of a relatively large number of individual parts, and the longitudinal guides for the holding elements can become sluggish as a result of dust-laden ambient air.

The object of the invention is to improve an overhead throwing sweeping machine to the effect that the device for jointly resetting the longitudinal axis of the sweeping roller and the bottom edge of the inlet opening of the dirt container is of simpler construction and less susceptible to trouble.

To achieve this object, an overhead throwing sweeping machine of the type mentioned at the beginning is configured, according to the invention, in such a way that one of the pivoted arms of the sweeping roller is a double-armed lever which, at its arm remote from the longitudinal axis of the sweeping roller, has a bearing surface for the cable control, the one end of which is held in place when the sweeping roller is lowered into the sweeping position and the other end of which is connected to an adjusting mechanism, such that the cable control holds the pivoted arms in the position for the sweeping position of the sweeping roller by engagement with the bearing surface, and in that the at least one supporting element for the dirt container is coupled to the adjusting mechanism, such that the adjustment of the latter both changes the length of the cable control and correspondingly displaces the at least one supporting element.

In the sweeping machine according to the invention, therefore, the sweeping roller axis and the dirt container are reset by a mechanism which acts on the pivoted arms, coupled to one another, of the sweeping roller and the support of the dirt container only on one side of the frame of the sweeping machine, wherein in particular the cable control, adjustable in length, acts on the retainer of the sweeping roller in such a way that it effects the pivoting of the pivoted arms in direct engagement with one of the pivoted arms; that is to say no supporting or holding elements have to be displaced along flat bearing surfaces. This prevents a situation in which sluggishness of the entire mechanism can occur due to dust deposit.

The cable control, which supports the pivoted arms of the sweeping roller in the sweeping position, is connected to an adjusting mechanism, to which the at least one supporting element for the dirt container is also coupled. If the adjusting mechanism is therefore actuated for resetting the position of the longitudinal axis of the sweeping roller and the effective length of the cable control is increased as a result, the support of the dirt container is also correspondingly displaced, such that the bottom edge of the inlet opening of the dirt container is correspondingly adapted to the changed position of the sweeping roller.

The cable control is preferably a Bowden control, the sleeve sections of which are fixedly arranged close to the movable bearing surface relative to the cable.

The adjusting mechanism can be a screw spindle which is retained in a rotatable but axially non-displaceable manner and on which an adjusting nut sits which is non-rotatable relative to the machine frame, and the cable control can be fixedly connected to the adjusting nut, to which a linkage is coupled for displacing the at least one supporting element. In this case, the screw spindle is preferably arranged essentially perpendicularly to the supporting plane and it can have a handle element for the manual rotation at one end. The adjusting nut is displaced along the screw spindle by rotating the screw spindle, and the effective length of the cable control connected to the adjusting nut is thus changed. Such a construction is robust and simple and it permits easy and accurate manual resetting.

The at least one supporting element for supporting the dirt container can have a curved supporting surface and is retained on the machine frame in a pivotable manner, and a push rod can act on the at least one supporting element and is coupled to the adjusting nut via a pivoted lever. During rotation of the screw spindle for resetting the sweeping area of the sweeping roller, the at least one supporting element is then pivoted via the pivoted lever and the push rod, such that another region of the curved supporting surface becomes effective. In this case, the shape of the supporting surface can be adapted to the desired resetting profile of the dirt container.

In order to effect a uniform support of the dirt container, the at least one supporting element can be provided at a side region of the machine frame, and a further supporting element rigidly coupled to said supporting element and having a corresponding surface can be arranged at the opposite side region of the machine frame, such that the relatively heavy dirt container is supported in its two outer regions.

In order to be able to adjust the sweeping roller between a position for sweeping operation and a position for travel operation, in which the sweeping roller is lifted off the floor, the one end of the cable control can be coupled to an actuating lever which, when actuated in one direction, displaces the end of the cable control in such a way that the bearing surface is pressed down and as a result the sweeping roller is lifted into the position for travel operation.

The invention is explained in more detail below with reference to the figures, which show an exemplary embodiment in a simplified and schematic manner.

Figure 1:
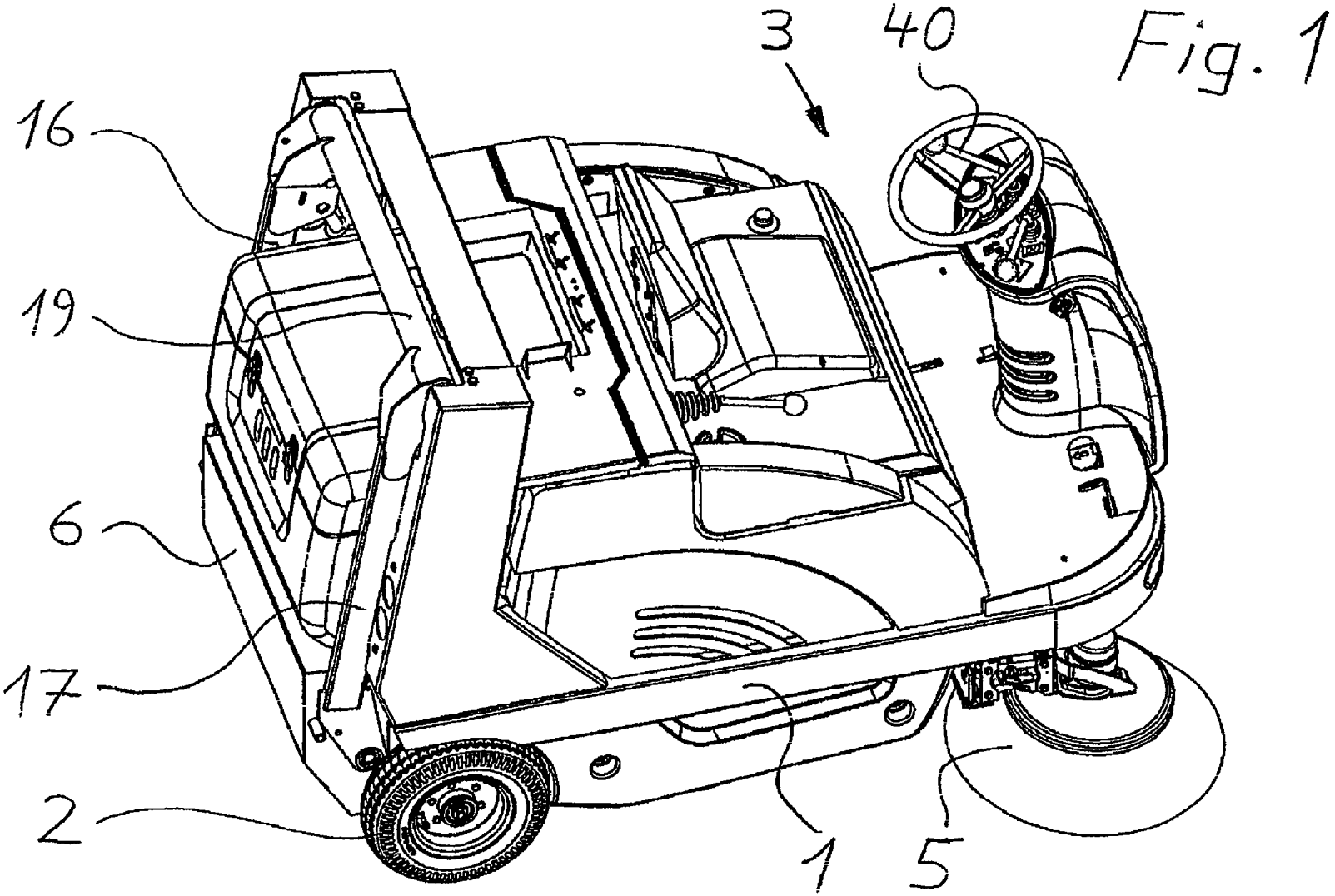
FIG. 1 shows an overhead throwing sweeping machine in a perspective illustration.
Figure 2:
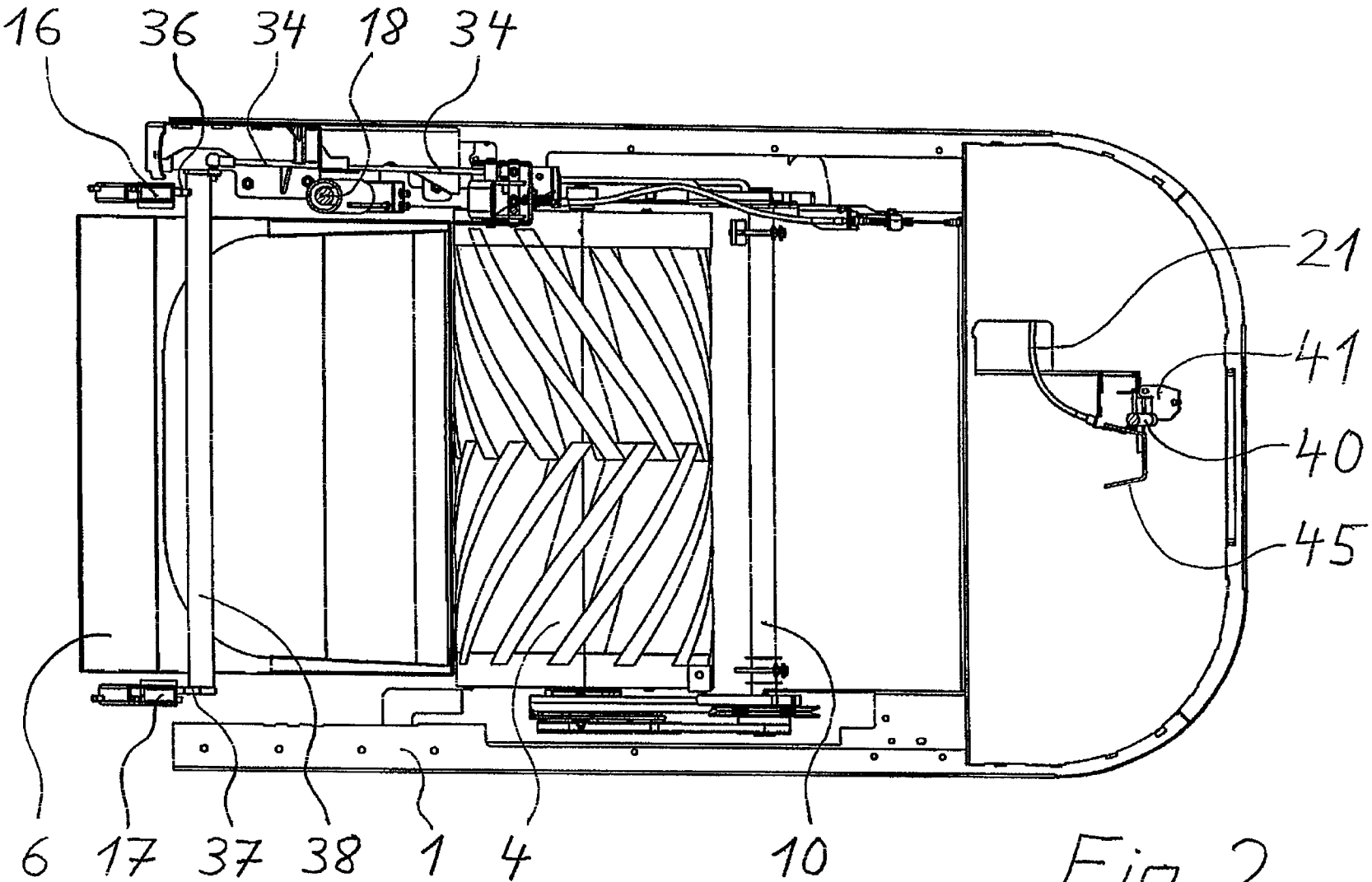
FIG. 2 shows the bottom part of the sweeping machine from FIG. 1 in a horizontal section, parts that are not important for the invention being omitted.

In a conventional manner, the overhead throwing sweeping machine shown in FIG. 1 has a frame 1 which carries the various components and units of the sweeping machine, which is movable on wheels, of which only the wheel 2 is shown. The sweeping machine has a region 3 for the driver, a driver's seat and the normal operating elements being arranged in this region. A side brush 5 which is not of interest for the present case, but is a conventional side brush 5, is provided in the front region of the sweeping machine in a conventional manner.

Figure 3:
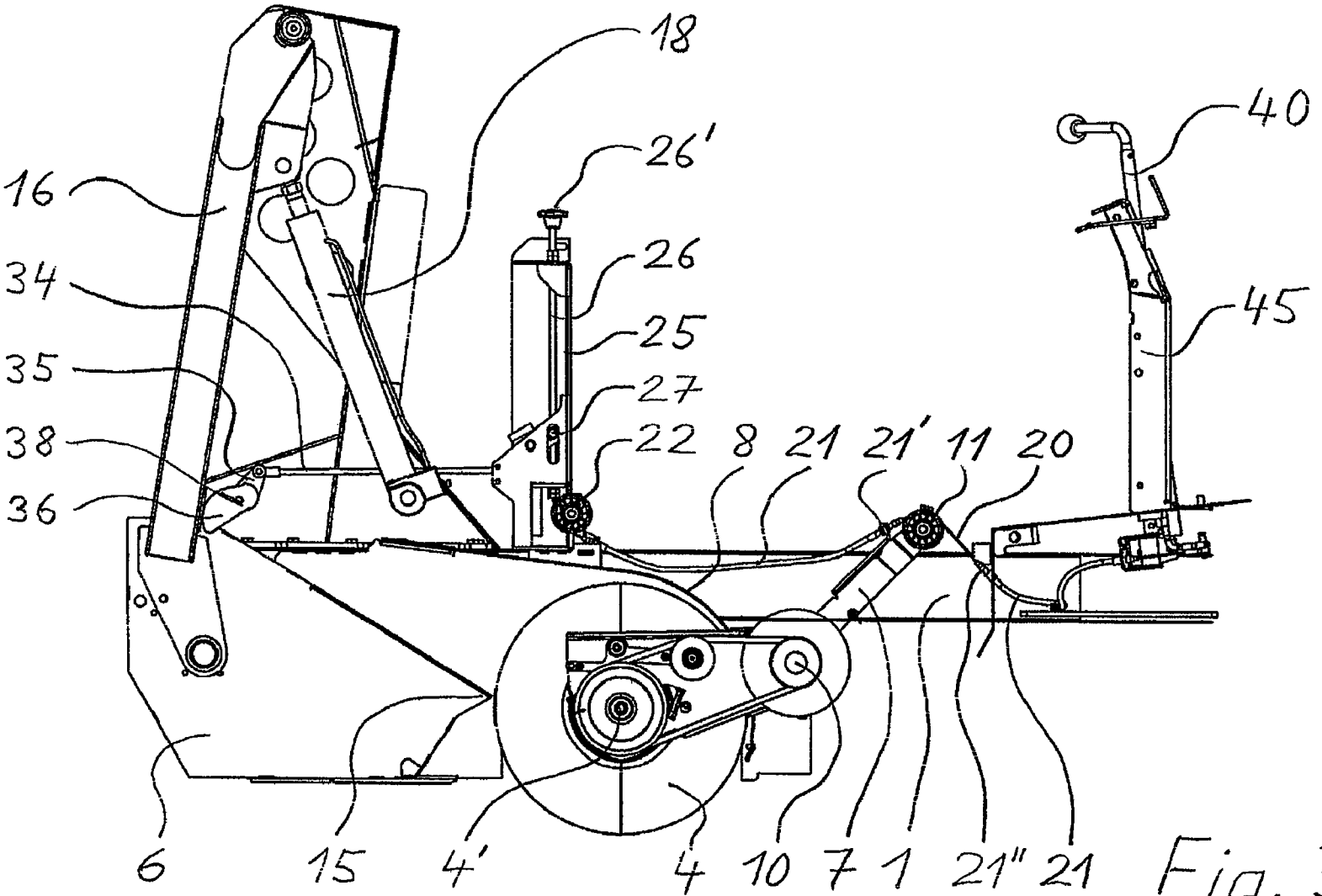
FIG. 3 shows, in a horizontal partial section, the suspension of the sweeping roller in a region inside the machine frame and close to one side of this frame, only the parts of interest for the explanation of the invention being shown.
Figure 4:
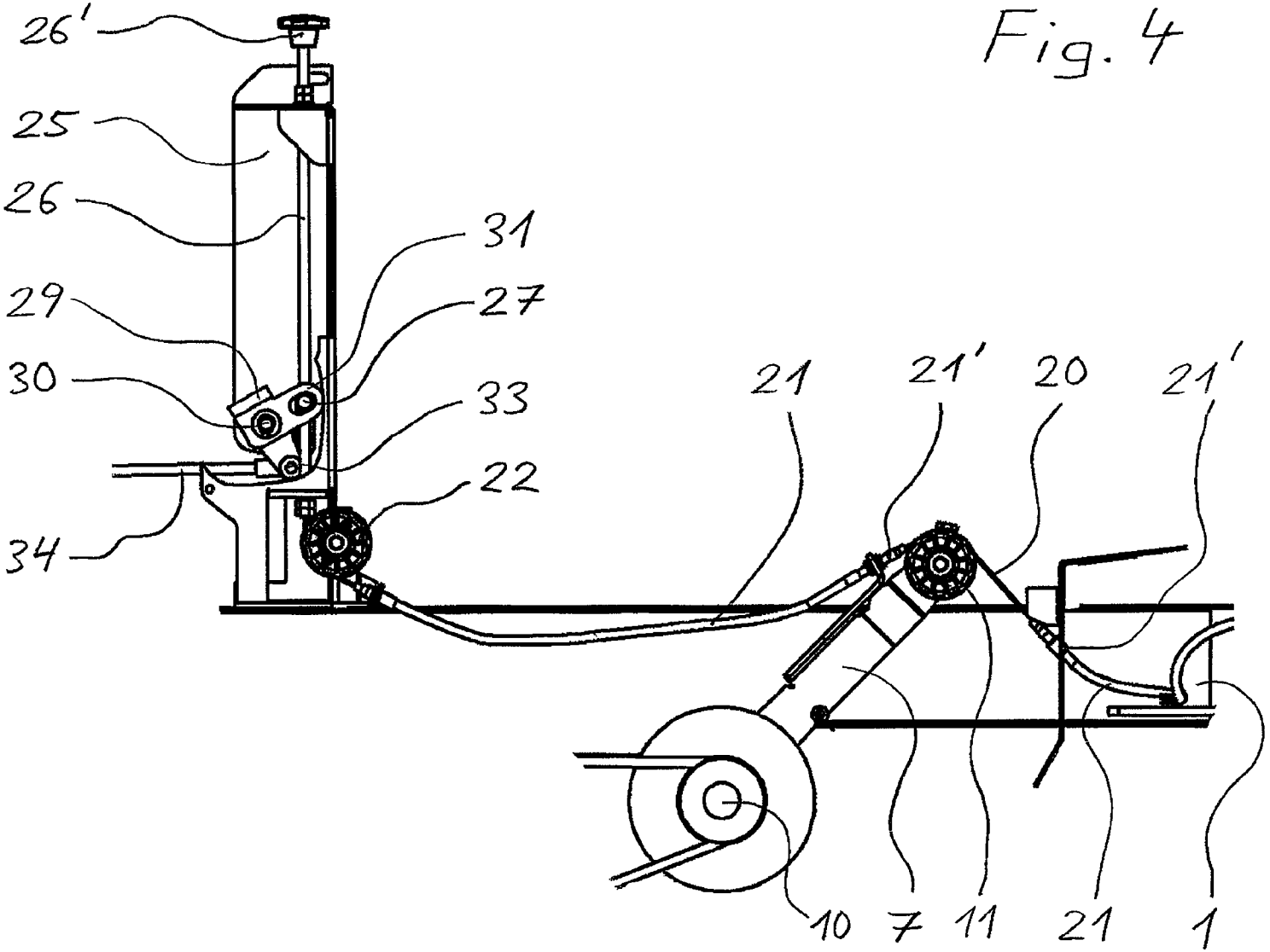
FIG. 4 shows a detail of FIG. 3 with the adjusting mechanism and a part of the pivoted arm designed as a double-armed lever, such that the coupling of the supporting element to the adjusting mechanism can be seen.
Figure 5:
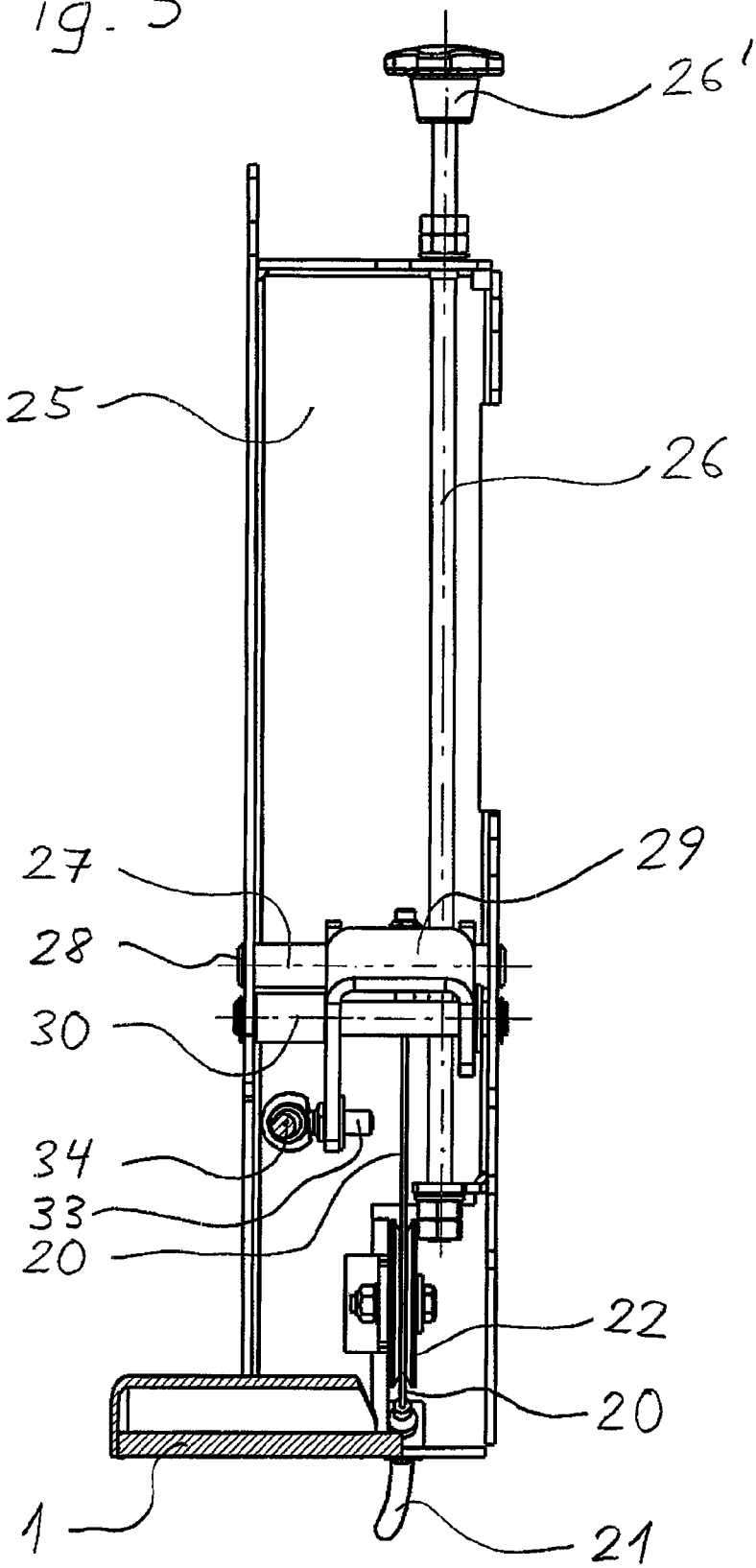
FIG. 5 shows the adjusting mechanism in a view from the rear in a partial illustration.
Figure 6:
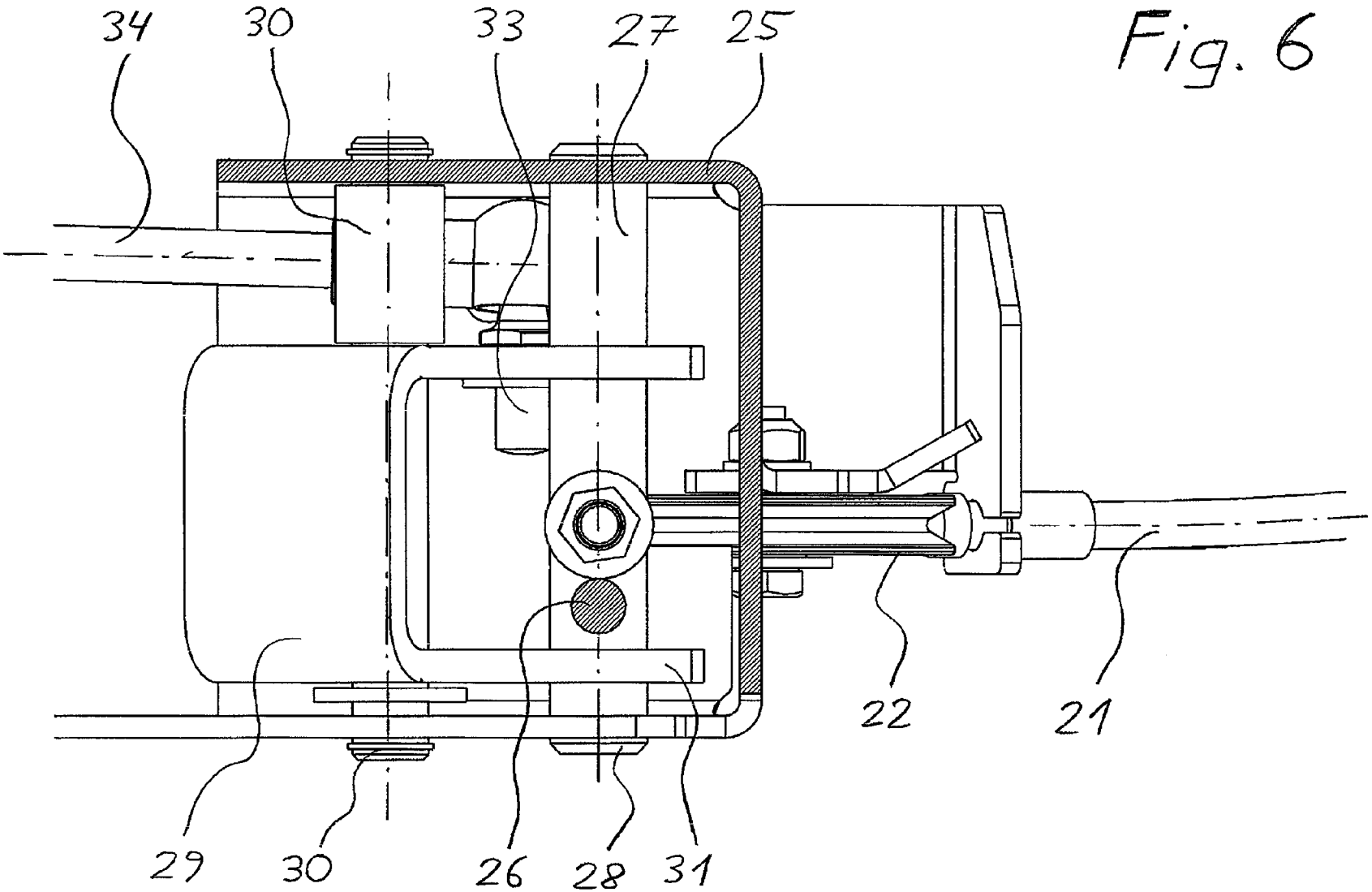
FIG. 6 shows a horizontal section through the adjusting mechanism.

The sweeping machine has a conventional cylindrical sweeping roller 4 which is retained via pivoted arms (not shown) coupled to one another via the spindle 10, such that pivoting of one of the pivoted arms results in pivoting of the other pivoted arm in the same direction and to the same extent, as a result of which the longitudinal axis 4' of the sweeping roller 4 is lifted or lowered along a curved path. Parts of the conventional drive mechanism (not of interest here) for rotating the sweeping roller 4 anticlockwise are also shown in FIGS. 3 and 4. If the sweeping roller 4 is in engagement with the floor to be cleaned and is rotated in a driven manner in this way, it hurls the dirt from the floor into the region of a "brush tunnel" which is defined at its top side by a tunnel wall 8 (FIG. 3), such that the dirt is directed along this brush tunnel into the receiving opening of the dirt container 6 arranged at the rear of the sweeping roller 4. In order to direct all the dirt into this receiving opening, its bottom edge 15 (FIG. 3) is located at an optimum, slight distance from the outer circumference of the sweeping roller 4.

The dirt container 6 is retained on two arms 16, 17, which are rigidly coupled to one another via a spindle 19 (FIG. 1), and it can be pivoted into a raised position, which enables the emptying, by activating a working cylinder 18 (FIG. 3).

This construction, described thus far, of an overhead throwing sweeping machine is conventional.

As indicated in FIGS. 3 and 4, one of the pivoted arms retaining the sweeping roller 4 is in the form of a double-armed lever, whose arm 7 remote from the longitudinal axis 4' of the sweeping roller 4 carries at its outer end a roller 11 forming a bearing surface. Running over this roller is part 20 of a Bowden control, the sleeve 21 of which is interrupted in this region and is attached here fixedly in relation to the frame at 21" and fixedly to the arm 7 at 21'. The Bowden control or its cable 20 is fixedly connected at the front end to a linkage arrangement, which during sweeping operation is held in a non-displaceable manner. In the rear region, the cable 20 of the Bowden control runs upwards via a deflection roller 22, where the rear end of the cable 20 is fixedly connected to an adjusting nut 27. The adjusting nut 27 sits on a screw spindle 26 which is arranged so as to be rotatable, but axially non-displaceable, on a support 25 which extends essentially perpendicularly to a supporting plane formed by the bearing surface of the wheels of the sweeping machine and is fastened to a frame 1. Provided at the top end of the screw spindle 26 is a handle element 26' which enables the screw spindle to be rotated manually. At its outer ends, the adjusting nut 27 has pin elements 28 which engage in perpendicularly running guide slots of the support 25 (FIG. 3), such that the adjusting nut is held in a non-rotatable manner relative to the screw spindle 26. Rotation of the screw spindle 26 therefore produces an upwards or downwards movement of the adjusting nut 27 and thus a corresponding displacement of the rear end, fastened to it, of the cable 20 of the Bowden control.

A U-shaped pivoted lever 29 is located on a spindle 30 rotatably mounted in the support 25. That end 31 of the pivoted lever which is provided with elongated holes is coupled to the adjusting nut 27. Located on the other end of the pivoted lever 29 is a spindle stub with a joint, to which the push rod 34 is linked. The latter extends rearwards and is coupled to an arm 35 which is fixedly connected to a supporting element 36. The supporting element 36 is connected via the spindle 38 to a further supporting element 37 which is located in the region of the opposite side of the frame 1. The supporting elements 36 and 37 have curved supporting surfaces, against which the arms 16 and 17 carrying the dirt container 6 bear during sweeping operation, such that the position of the dirt container 6 and in particular the position of the bottom edge 15 of the receiving opening of the dirt container relative to the outer circumference of the sweeping roller 4 are fixed by the orientation of the supporting elements 36 and 37 in interaction with the shape of their supporting surface.

During sweeping operation, the effective length of the cable 20, by its engagement with the bearing surface formed by the roller 11, determines the pivoted position of the pivoted arms retaining the sweeping roller 4 and thus determines the "sweeping area", i.e. the region in which the free ends of the bristles of the sweeping roller 4 come into engagement with the floor to be cleaned. At the same time, via the screw spindle 26 and the push rod 34 connected to it via the adjusting nut 27 and the pivoted lever 29, in interaction with the shape of the supporting surfaces of the supporting elements 36 and 37, the position of the front edge 15 relative to the circumference of the sweeping roller 4 is fixed, such that both an optimum size of the brush tunnel formed between sweeping roller 4 and tunnel wall 8 and an optimum distance of the front edge 15 of the receiving opening of the dirt container 6 relative to the outer circumference of the sweeping roller 4 are obtained.

If the bristles of the sweeping roller 4 become worn during cleaning operation, the sweeping area can be reset by the longitudinal axis 4' of the sweeping roller 4 being lowered in a controlled manner. To this end, the screw spindle 26 is rotated in such a way that the adjusting nut 27 moves downwards. This leads to an increase in the effective length of the cable 20, as a result of which the arm 7 of the pivoted arms loaded in the direction of lowering of the sweeping roller 4 can lift, i.e. corresponding pivoting of the pivoted arms anticlockwise (FIG. 3) and thus lowering of the longitudinal axis 4' of the sweeping roller 4 until the desired sweeping area is achieved again are effected.

During the lowering of the adjusting nut 27 for resetting the sweeping area, that end 31 of the lever 29 which is connected to it is pivoted clockwise (FIG. 4) about the spindle 30, as a result of which the other end is also pivoted clockwise and the connection 33 for the push rod 34 is displaced rearwards. This displacement of the push rod causes the arm 35 and thus the supporting elements 36, 37 to pivot anticlockwise about the spindle 38, i.e. the arms 16, 17 retaining the dirt container 6 are pivoted slightly anticlockwise about the spindle 19. As a result, the bottom edge 15 of the receiving opening of the dirt container 6 approaches the outer circumference of the sweeping roller 4 up to an optimum distance.

Therefore lowering of the sweeping roller 4 for restoring an optimum sweeping area and an optimum change in position relative to the brush tunnel and also an approach of the bottom edge 15 of the receiving opening of the dirt container 6 to the circumference of the sweeping roller 4 up to an optimum distance are effected solely by rotation of the screw spindle 26.

Figure 7:
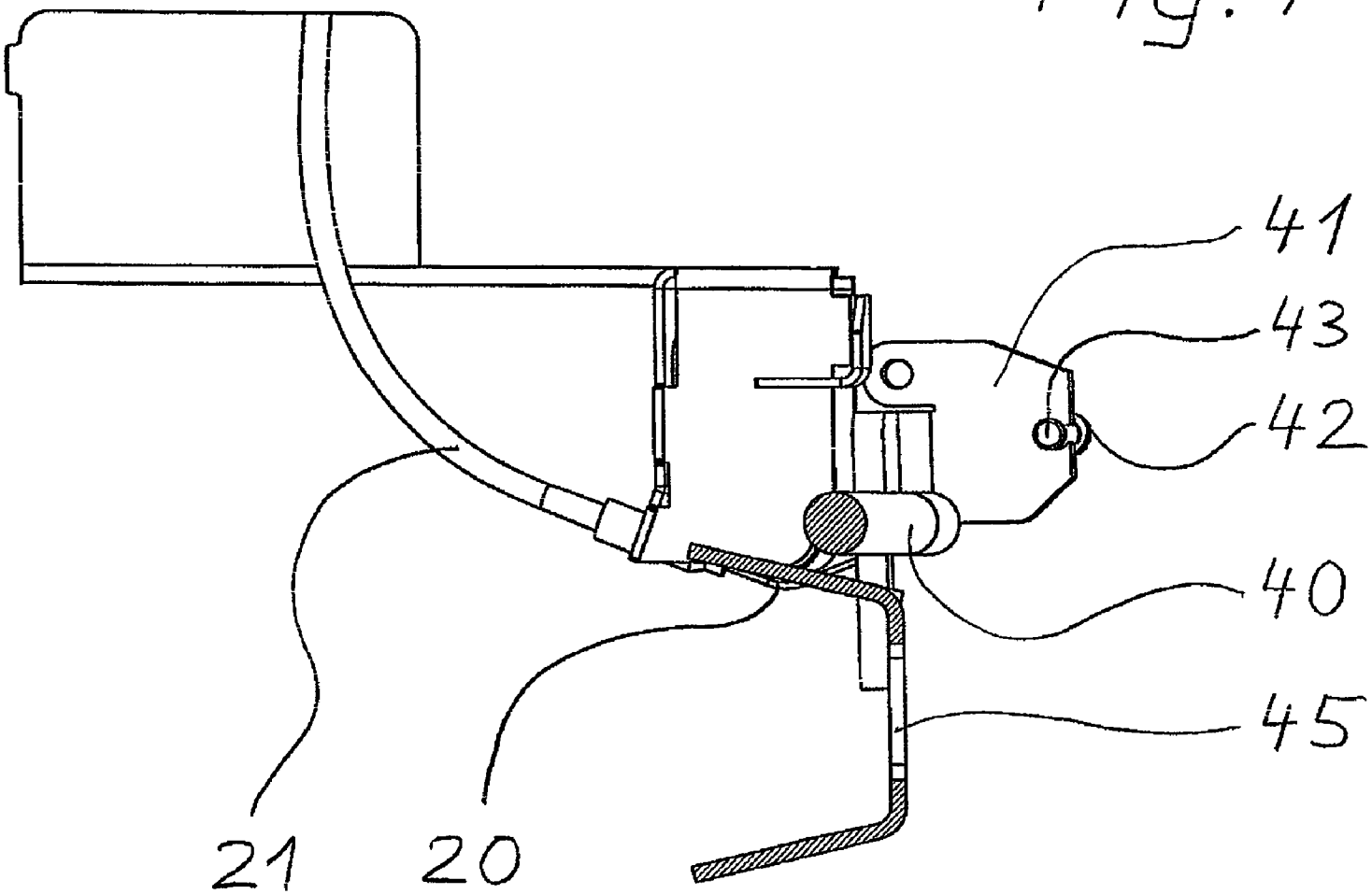
FIG. 7 shows, in a simplified horizontal partial section, the arrangement for lifting the sweeping roller into the position for travel operation.
Figure 8:
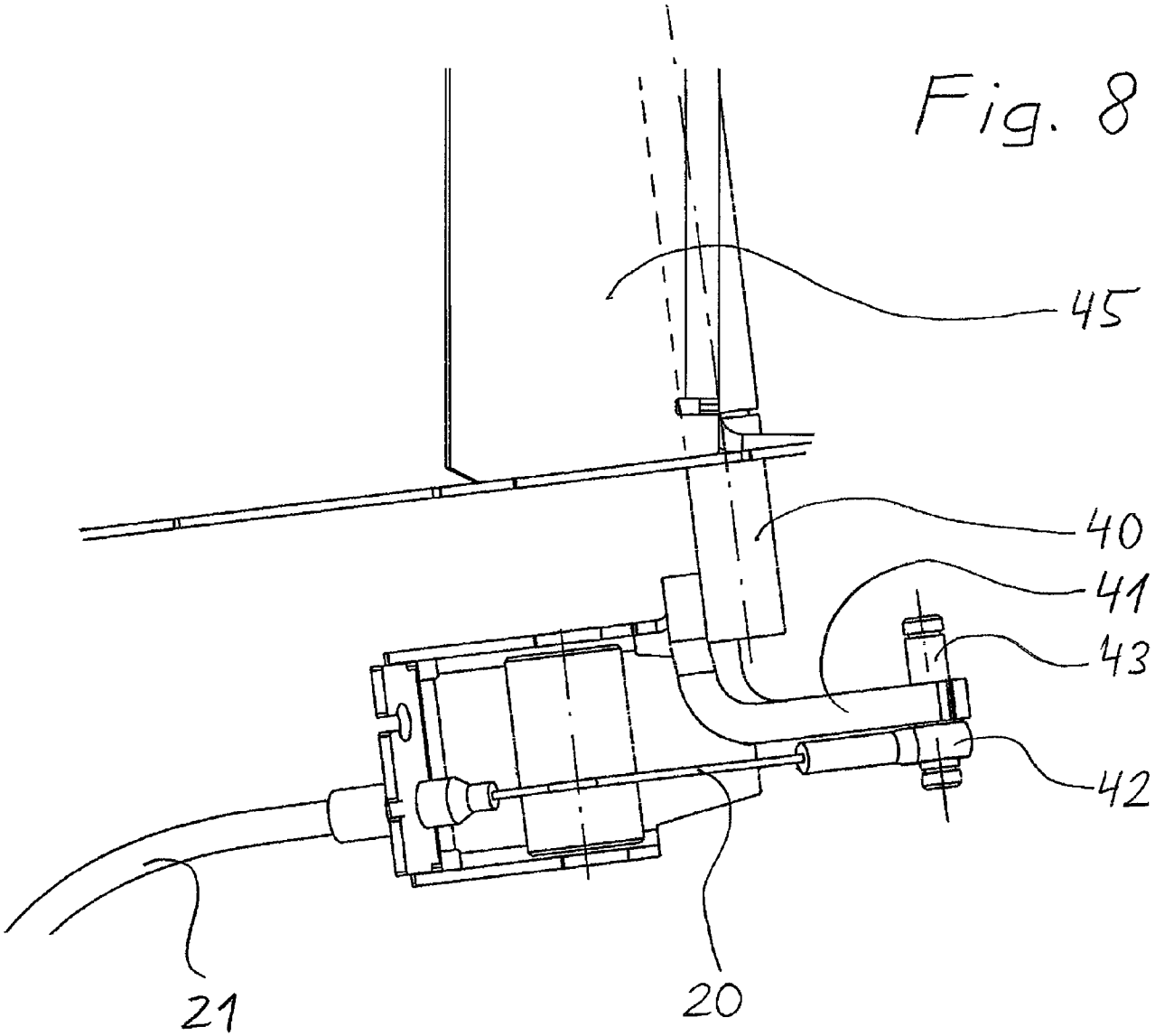
FIG. 8 shows parts of the arrangement from FIG. 7 in a side view.

The front end of the cable 20 of the Bowden control is fastened with a lug 42 to a pin 43 (FIGS. 7 and 8) which is part of the intermediate lever 41. This intermediate lever is fastened to a rod-shaped actuating element 40 which is mounted on a stand 45 retained on the frame 1 and which has at its top end an angled handle section which, as indicated in FIG. 1, is directly accessible to the driver.

If the sweeping roller 4 is to be lifted for moving the sweeping machine, the driver turns the actuating element 40, angled to form a handle section, anticlockwise (FIG. 7), and that end of the cable 20 of the Bowden control which is fastened to the intermediate lever 41 is displaced forwards. This leads to a marked reduction in the effective length of the cable 20, such that the bearing surface formed by the roller 11 is pressed down as a result and in this way the pivoted arms retaining the sweeping roller 4 are pivoted clockwise (FIG. 3) and the sweeping roller 4 is therefore lifted from the sweeping position.

The invention claimed is:

1. An overhead throwing sweeping machine comprising a machine frame (1) for retaining wheels (2), whose regions coming to bear on the floor to be cleaned lie in a supporting plane, and the other components of the sweeping machine, a cylindrical sweeping roller (4) which is rotatable about its longitudinal axis and is retained on jointly adjustable pivoted arms and whose bristles located in a region of a sweeping area during cleaning operation move in a direction of the forward travel of the cleaning machine, a tunnel wall (8) covering a front and a top region of the sweeping roller (4) and defining a brush tunnel, and a dirt container (6) which is arranged behind the sweeping roller (4) and whose inlet opening faces an end of the brush tunnel and lies with its bottom edge (15) adjacent to the sweeping roller (4) and which, in its dirt-receiving position, is held by at least one displaceable supporting element (36) in a position supported relative to the sweeping roller (4), wherein, to set the sweeping area, the pivoted arms of the sweeping roller (4) are pivoted by adjusting a cable control (20) and in the process a position of the at least one supporting element (36) is also changed, such that the setting of the sweeping area is combined with the setting of an optimum distance between sweeping roller (4) and tunnel wall (8) and with the setting of the optimum distance of the inlet opening of the dirt container (6) from the sweeping roller (4), characterized in that one of the pivoted arms of the sweeping roller (4) is a double-armed lever which, at its arm (7) remote from the longitudinal axis (4') of the sweeping roller (4), has a bearing surface (11) for the cable control (20), one end of which is held in place when the sweeping roller (4) is lowered into a sweeping position and another end of which is connected to an adjusting mechanism, such that the cable control (20) holds the pivoted arms in the position for the sweeping position of the sweeping roller (4) by engagement with the bearing surface (11), and in that the at least one supporting element (36) is coupled to the adjusting mechanism, such that the adjustment of the latter both changes an effective length of the cable control (20) and correspondingly displaces the at least one supporting element (36).

2. An overhead throwing sweeping machine according to claim 1, characterized in that the cable control is a Bowden control (20, 21), sleeve sections (21') of which are fixedly arranged close to the bearing surface (11) relative to the cable (20).

3. An overhead throwing sweeping machine according to claim 1 characterized in that the adjusting mechanism has a screw spindle (26) which is retained in a rotatable but axially non-displaceable manner and on which an adjusting nut (27) sits which is non-rotatable relative to the machine frame (1), and in that the cable control (20) is fixedly connected to the an adjusting nut (27) sits which is non-rotatable relative to the machine frame (1), and in that the cable control (20) is fixedly connected to the adjusting nut (27) and a linkage (29, 34) is coupled to the latter for displacing the at least one supporting element (36).

4. An overhead throwing sweeping machine according to claim 3, characterized in that the screw spindle (26) is arranged essentially perpendicularly to the supporting plane.

5. An overhead throwing sweeping machine according to claim 4, characterized in that a handle element (26') for the manual rotation of the screw spindle (26) is provided at one end of the screw spindle (26).

6. An overhead throwing sweeping machine according to claim 3, characterized in that the at least one supporting element (36) has a curved supporting surface and is retained on the machine frame in a pivotable manner, and in that a push rod (34) acts on the at least one supporting element (36) and is coupled to the adjusting nut (27) via a pivoted lever (29).

7. An overhead throwing sweeping machine according to claim 6, characterized in that the at least one supporting element (36) is provided at a side region of the machine frame (1), and in that a further supporting element (37) rigidly coupled to said supporting element (36) and having a corresponding surface is arranged at an opposite side region of the machine frame (1).

8. An overhead throwing sweeping machine according to claim 1, characterized in that the one end of the cable control (20) is coupled to an actuating element (40), with which the cable control (20) can be adjusted between a position for sweeping operation and a position for travel operation, in which the sweeping roller (4), is lifted from the floor.

9. An overhead throwing sweeping machine according to claim 3, characterized in that the one end of the cable control (20) is coupled to an actuating element (40), with which the cable control (20) can be adjusted between a position for sweeping operation and a position for travel operation, in which the sweeping roller (4), is lifted from the floor.

10. An overhead throwing sweeping machine according to claim 6, characterized in that the one end of the cable control (20) is coupled to an actuating element (40), with which the cable control (20) can be adjusted between a position for sweeping operation and a position for travel operation, in which the sweeping roller (4), is lifted from the floor.

* * * * *